US012196448B1

(12) United States Patent
Tauriainen

(10) Patent No.: US 12,196,448 B1
(45) Date of Patent: Jan. 14, 2025

(54) SINK DRAIN DEVICES AND METHODS

(71) Applicant: Qanna, LLC, New Waverly, TX (US)

(72) Inventor: Caleb B. Tauriainen, New Waverly, TX (US)

(73) Assignee: Qanna, LLC, New Waverly, TX (US)

( * ) Notice: Subject to any disclaimer, the term of this patent is extended or adjusted under 35 U.S.C. 154(b) by 0 days.

(21) Appl. No.: 18/818,063

(22) Filed: Aug. 28, 2024

Related U.S. Application Data

(60) Provisional application No. 63/534,956, filed on Aug. 28, 2023.

(51) Int. Cl.
*F24F 13/22* (2006.01)
*E03C 1/262* (2006.01)

(52) U.S. Cl.
CPC ..... *F24F 13/222* (2013.01); *E03C 1/262* (2013.01); *F24F 2013/228* (2013.01)

(58) Field of Classification Search
CPC ..... E03C 1/24; E03C 1/262
USPC ..... 4/287, 469
See application file for complete search history.

(56) References Cited

U.S. PATENT DOCUMENTS 216,006 A * 5/1879 Wemple ..... E03C 1/24 4/293
302,253 A * 7/1884 Hoffman ..... E03C 1/24 4/293
321,973 A * 7/1885 Johnson ..... E03C 1/24 4/293
3,064,275 A 11/1962 Allen
6,301,917 B1 10/2001 Lacoste
6,442,956 B1 9/2002 Herren
6,845,528 B2 1/2005 Bantz
7,877,821 B1 2/2011 Prestia
9,339,150 B1 5/2016 Risko

FOREIGN PATENT DOCUMENTS

CA 2 648 129 6/2010
CN 110107770 A 8/2019

* cited by examiner

*Primary Examiner* — Lauren A Crane
(74) *Attorney, Agent, or Firm* — Quisenberry Law PLLC

(57) ABSTRACT

A sink apparatus may include a central support member, a forward support member, and a rear support member. The central support member may include an upper engagement member to engage a sink faucet, and a lower engagement member to engage a main sink drain that is in fluid communication with an air conditioner drain line. The forward support member may include a forward engagement member to engage a sink overflow drain that is in fluid communication with the air conditioner drain line. The rear support member may include a rear engagement member to engage a rear wall of a sink. By using the sink apparatus to cover the main sink drain and the overflow sink drain, overflow or escape of debris from the air conditioner drain line through the main sink drain and the overflow sink drain is prevented when compressed air is applied to the air conditioner drain line.

20 Claims, 9 Drawing Sheets

SINK DRAIN DEVICES AND METHODS

RELATED APPLICATIONS

This application claims the benefit of U.S. Provisional Application No. 63/534,956, filed Aug. 28, 2023, the contents of which is fully incorporated herein by reference.

BACKGROUND OF THE INVENTIONS

1. Field of the Inventions

The present inventions are designed for the HVAC industry and plumbing industry and generally pertain to maintenance of HVAC equipment, and more particularly to sink drain devices and methods.

2. Description of the Related Art

It is known that air conditioning (AC) units that are installed in an attic of a house include a drain line for draining condensate emanating from the air conditioning unit. Sometimes those drain lines extend from the attic to a location outside of the house. In other situations, those drain lines can drain into a sink located somewhere in the house below the attic, such as in a bathroom. It is important that the AC drain line does not become clogged. If that happens, then water can overflow and leak from the attic into other parts of the house and cause damage. As such, it is not uncommon for HVAC specialists to use compressed air to blow clogs out of an AC drain line. In those situations where the drain line is connected to a sink somewhere in the house, blowing compressed air through the drain line can blow debris out of the sink and into the surrounding room, thereby causing a mess if precautionary measures are not taken. One precautionary measure is to place a towel or other material into the sink to prevent the compressed air from blowing debris out of the sink and into the bathroom.

As will become apparent from the following descriptions and discussion, the present inventions encompass novel and unique sink drain devices and methods for preventing compressed air from blowing debris out of the sink and into the surrounding room.

SUMMARY OF THE INVENTIONS

In one aspect, the present inventions may be used to prevent pressure blowback, drain outburst, and sink mess when air conditioning primary drain lines need to be cleared with pressurized air from the attic. In on aspect, the present inventions may reduce the need for a towel or additional person to be covering the sink outlets downstairs so pressure can be applied without a mess being made.

In another aspect, the present inventions may include a sink apparatus for containing debris when compressed air is applied to a drain line that is connected to a sink drain, the sink apparatus comprising: a central support member having an elongated body member, an upper engagement member and a lower engagement member, the upper engagement member being moveable relative to an upper end of the elongated body member of the central support member, and the lower engagement member being movable relative to a lower end of the elongated body member of the central support member; and a forward support member having an elongated body member and a forward engagement member, a rear end of the elongated body member of the forward support member being connected to the central support member, the forward engagement member being moveable relative to a forward end of the elongated body member of the forward support member. Another feature of this aspect of the present inventions may be that the sink apparatus may further include a rear support member having an elongated body member and a rear engagement member, a forward end of the elongated body member of the rear support member being connected to the central support member, the rear engagement member being moveable related to a rear end of the elongated body member of the rear support member. Another feature of this aspect of the present inventions may be that the forward support member is hingedly connected to the central support member. Another feature of this aspect of the present inventions may be that the rear support member is hingedly connected to the central support member. Another feature of this aspect of the present inventions may be that the elongated body member of the central support member includes an internal threaded bore extending therethrough, and the sink apparatus further includes an upper threaded rod threadably engaged with the internal treaded bore of the elongated body member of the central support member, and a lower threaded rod threadably engaged with the internal threaded bore of the elongated body member of the central support member. Another feature of this aspect of the present inventions may be that the upper threaded rod is connected to the upper engagement member, and the lower threaded rod is connected to the lower engagement member. Another feature of this aspect of the present inventions may be that the elongated body member of the forward support member includes an internal threaded bore extending therethrough, and the sink apparatus further includes a forward threaded rod threadably engaged with the internal treaded bore of the elongated body member of the forward support member, and the forward threaded rod is connected to the forward engagement member. Another feature of this aspect of the present inventions may be that the sink apparatus may further include a hinge support member slidably and releasably engaged with the central support member, and including a right hinge pivot member having a right threaded rod, the right threaded rod being threadably engaged with an internal threaded bore of the elongated body member of the forward support member. Another feature of this aspect of the present inventions may be that the forward engagement member includes a plurality of plug members.

In another aspect, the present inventions may include a sink apparatus for containing debris when compressed air is applied to a drain line that is connected to a sink drain, the sink apparatus comprising: a central support member having an elongated body member, an upper engagement member and a lower engagement member, the upper engagement member being moveable relative to an upper end of the elongated body member of the central support member, and the lower engagement member being movable relative to a lower end of the elongated body member of the central support member; a forward support member having an elongated body member and a forward engagement member, a rear end of the elongated body member of the forward support member being connected to the central support member, the forward engagement member being moveable relative to a forward end of the elongated body member of the forward support member; and a rear support member having an elongated body member and a rear engagement member, a forward end of the elongated body member of the rear support member being connected to the central support member, the rear engagement member being moveable related to a rear end of the elongated body member of the rear support member. Another feature of this aspect of the present inventions may be that each of the forward support member and the rear support member is hingedly connected to the central support member. Another feature of this aspect of the present inventions may be that the elongated body member of the central support member includes an internal threaded bore extending therethrough, and the sink apparatus further includes an upper threaded rod threadably engaged with the internal treaded bore of the elongated body member of the central support member, and a lower threaded rod threadably engaged with the internal threaded bore of the elongated body member of the central support member. Another feature of this aspect of the present inventions may be that the upper threaded rod is connected to the upper engagement member and includes an upper handle, and the lower threaded rod is connected to the lower engagement member and includes a lower handle. Another feature of this aspect of the present inventions may be that each of the upper handle and the lower handle is in the shape of a wing nut. Another feature of this aspect of the present inventions may be that the elongated body member of the forward support member includes an internal threaded bore extending therethrough, and the sink apparatus further includes a forward threaded rod threadably engaged with the internal treaded bore of the elongated body member of the forward support member, and the forward threaded rod is connected to the forward engagement member. Another feature of this aspect of the present inventions may be that the sink apparatus may further include a hinge support member slidably and releasably engaged with the central support member, and including a right hinge pivot member having a right threaded rod, the right threaded rod being threadably engaged with an internal threaded bore of the elongated body member of the forward support member. Another feature of this aspect of the present inventions may be that the forward engagement member includes a plurality of plug members.

In another aspect, the present inventions may include a method for containing debris when compressed air is applied to an air conditioner drain line that is connected to a sink drain, the method comprising: providing a sink apparatus having a central support member and a forward support member, the central support member having an upper engagement member and a lower engagement member, and the forward support member having a forward engagement member; engaging the upper engagement member of the central support member with a faucet attached to a sink; engaging the lower engagement member of the central support member with a sink drain of the sink that is in fluid communication with the air conditioner drain line; and engaging the forward engagement member of the forward support member with an overflow drain of the sink that is in fluid communication with the air conditioner drain line. Another feature of this aspect of the present inventions may be that the sink apparatus may further include engaging a rear engagement member of a rear support member that is attached to central support member with a wall of the sink. Another feature of this aspect of the present inventions may be that the sink apparatus may further include: rotating an upper threaded rod that is threadably engaged with an internal bore of the central support member and is connected to the upper engagement member; rotating a lower threaded rod that is threadably engaged with the internal bore of the central support member; and rotating a forward threaded rod that is threadably engaged with an internal bore of the forward support member.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTIONS

The present inventions will be described in various representative embodiments, as explained below. However, the scope of the present inventions are not limited to any of the details of the embodiments discussed below. Reference should be made to the appended claims, each of which defines a separate and distinct invention that is part of the present inventions.

Figure 1:
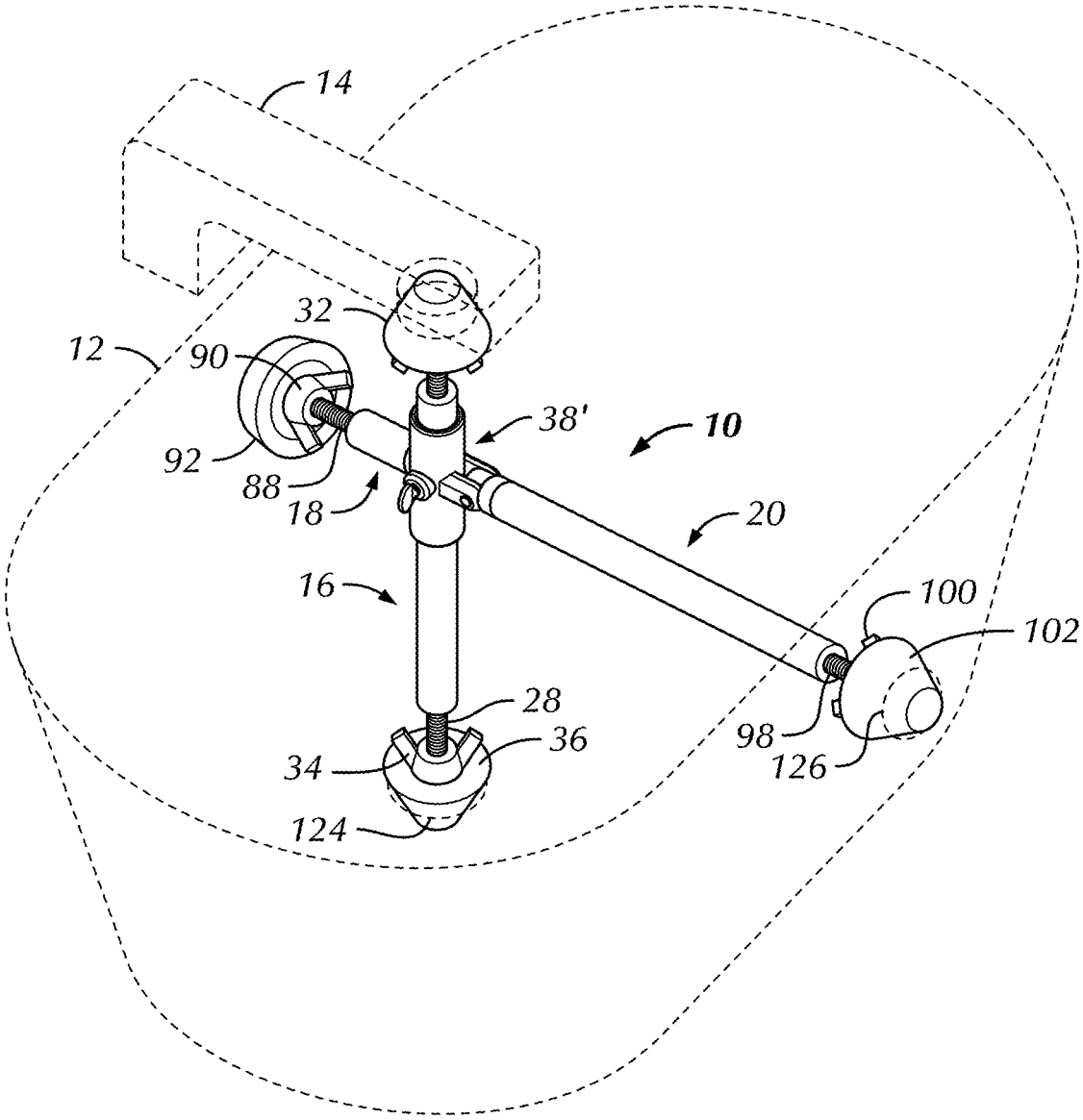
FIG. 1 is a perspective view of a specific embodiment of a sink apparatus according to one aspect of the present inventions positioned in a sink shown in dashed lines.
Figure 2:
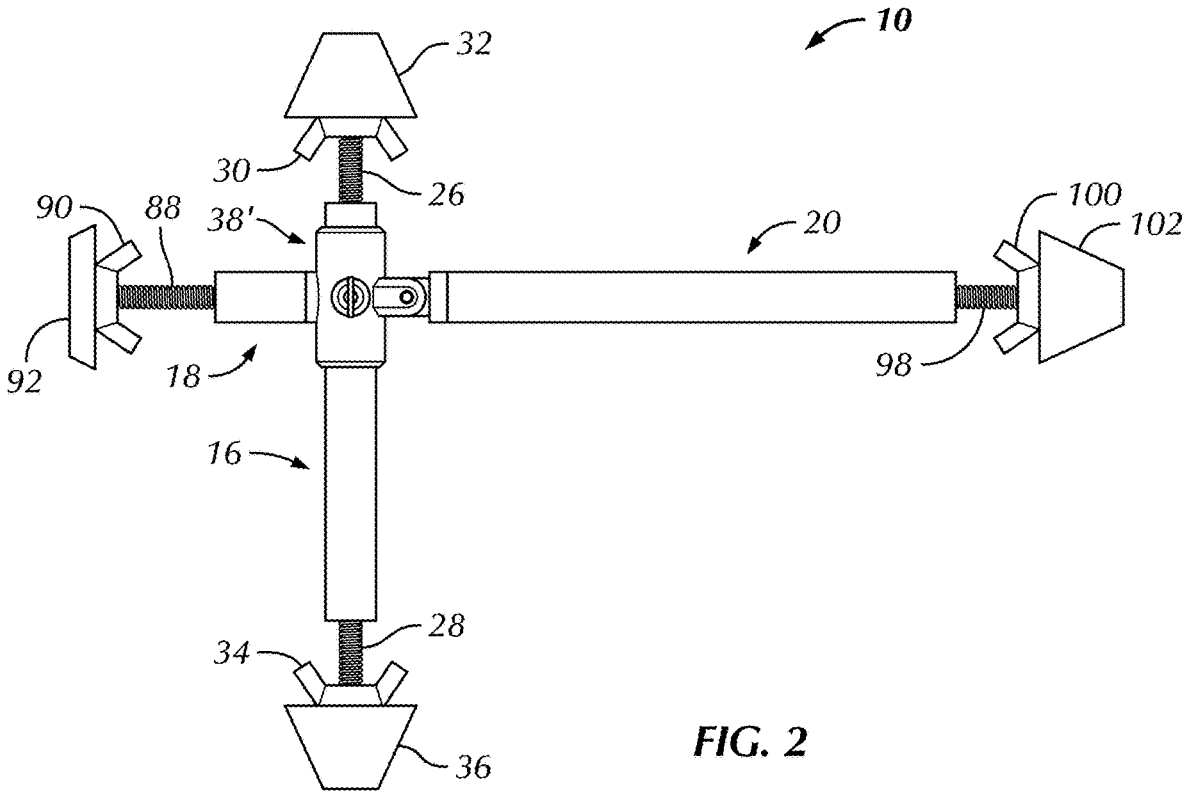
FIG. 2 is a side view of the sink apparatus shown in FIG. 1.
Figure 3:
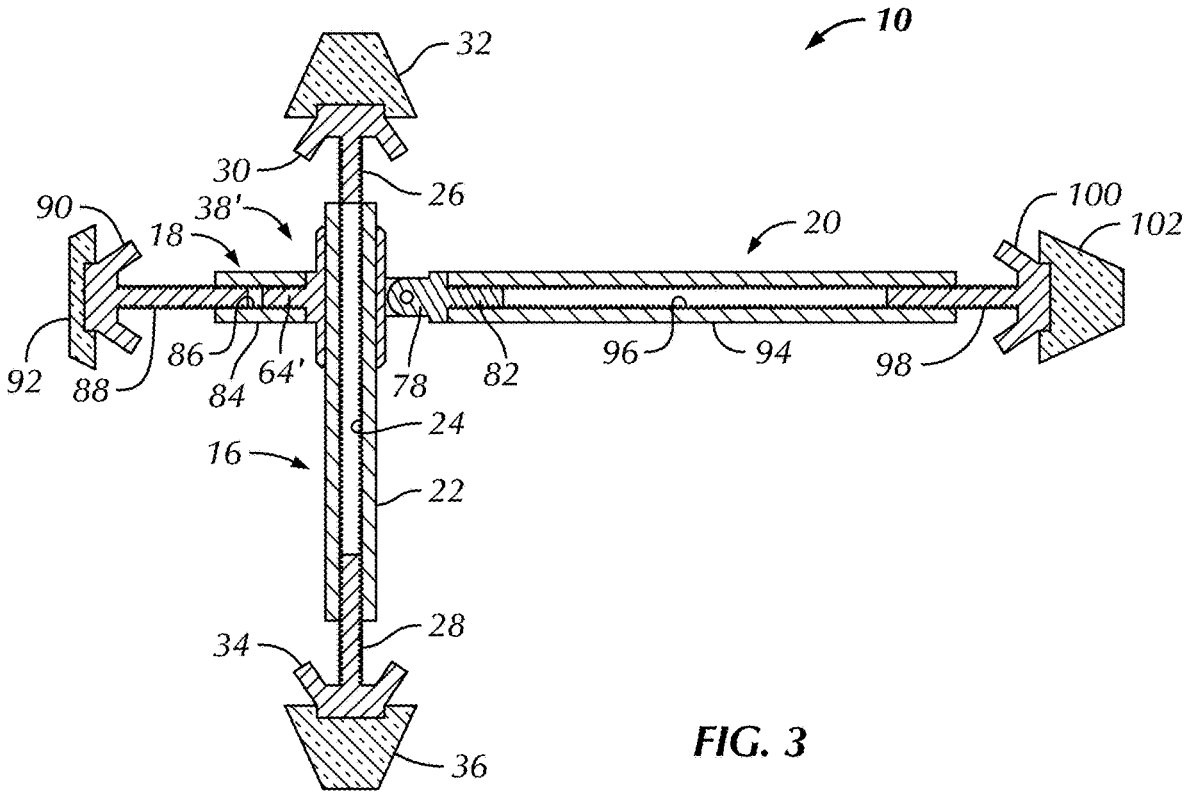
FIG. 3 is a side view similar to FIG. 2 but showing the sink apparatus in cross-section.

Referring now to FIGS. 1-3, a sink apparatus 10 is shown positioned in a sink 12 having a faucet 14, which are shown in dashed lines. In a specific embodiment, the sink apparatus 10 may include a central support member 16, a rear support member 18 that is mounted to the central support member 14 on a first side thereof, and a forward support member 20 that is mounted to the central support member 14 on a second side thereof, which may be opposite the first side of the central support member 14. In a specific embodiment, the rear support member 18 may be shorter than the forward support member 20.

In a specific embodiment, as shown in FIG. 3, the central support member 16 may include an elongated body member 22 having an internal threaded bore 24 extending therethrough. The central support member 16 may include an upper threaded rod 26 that is threadably engaged with the internal threaded bore 24 at an upper end of the body member 22. The central support member 16 may include a lower threaded rod 28 that is threadably engaged with the internal threaded bore 24 at a lower end of the body member 22. In a specific embodiment, the upper threaded rod 26 may include an upper handle 30 that may be formed as part of the upper threaded rod 26. In a specific embodiment, the upper handle 30 may be in the shape of a wing nut. In a specific embodiment, the upper threaded rod 26 may be connected to an upper engagement member 32. In a specific embodiment, the upper engagement member 32 may be connected to the upper handle 30. In a specific embodiment, the lower threaded rod 28 may include a lower handle 34 that may be formed as part of the lower threaded rod 28. In a specific embodiment, the lower handle 34 may be in the shape of a wing nut. In a specific embodiment, the lower threaded rod 28 may be connected to a lower engagement member 36. In a specific embodiment, the lower engagement member 36 may be connected to the lower handle 34. In a specific embodiment, the upper and lower engagement members 32 and 36 may be formed from a rubber material. In a specific embodiment, the upper and lower engagement members 32 and 36 may have a trapezoidal cross-section, and may have the shorter side of the trapezoidal member positioned away from its corresponding handle 30/34 (i.e., at a distal end relative to its corresponding threaded rod 26/28).

Figure 8:
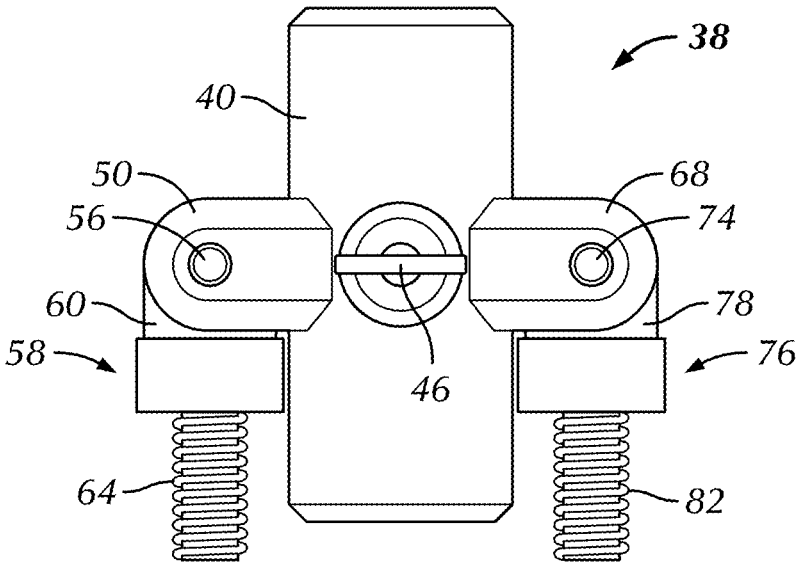
FIG. 8 is a side view of a specific embodiment of a hinge support member that may form part of a sink apparatus constructed in accordance with one aspect of the present inventions.
Figure 9:
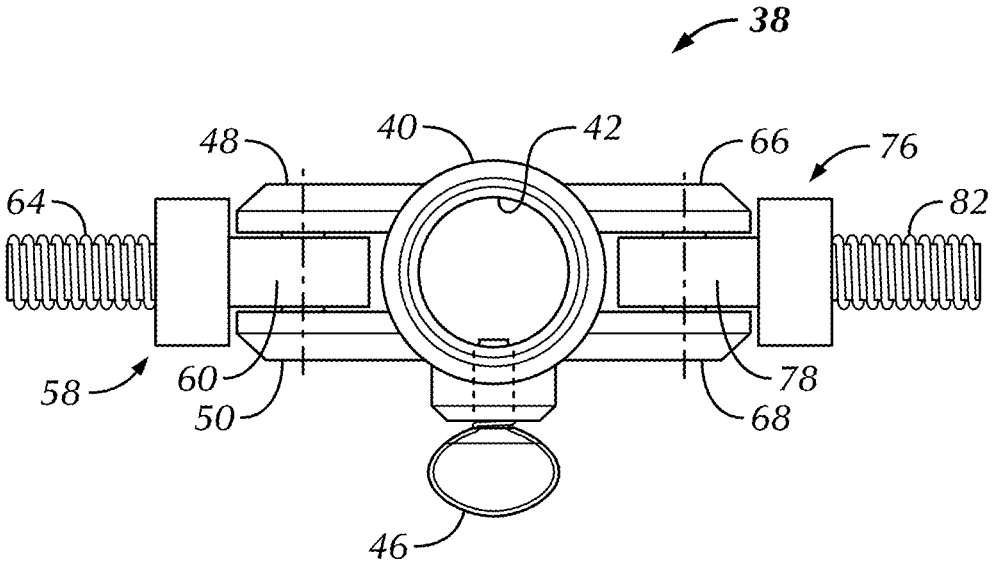
FIG. 9 is a top view of the hinge support member shown in FIG. 8.
Figure 10:
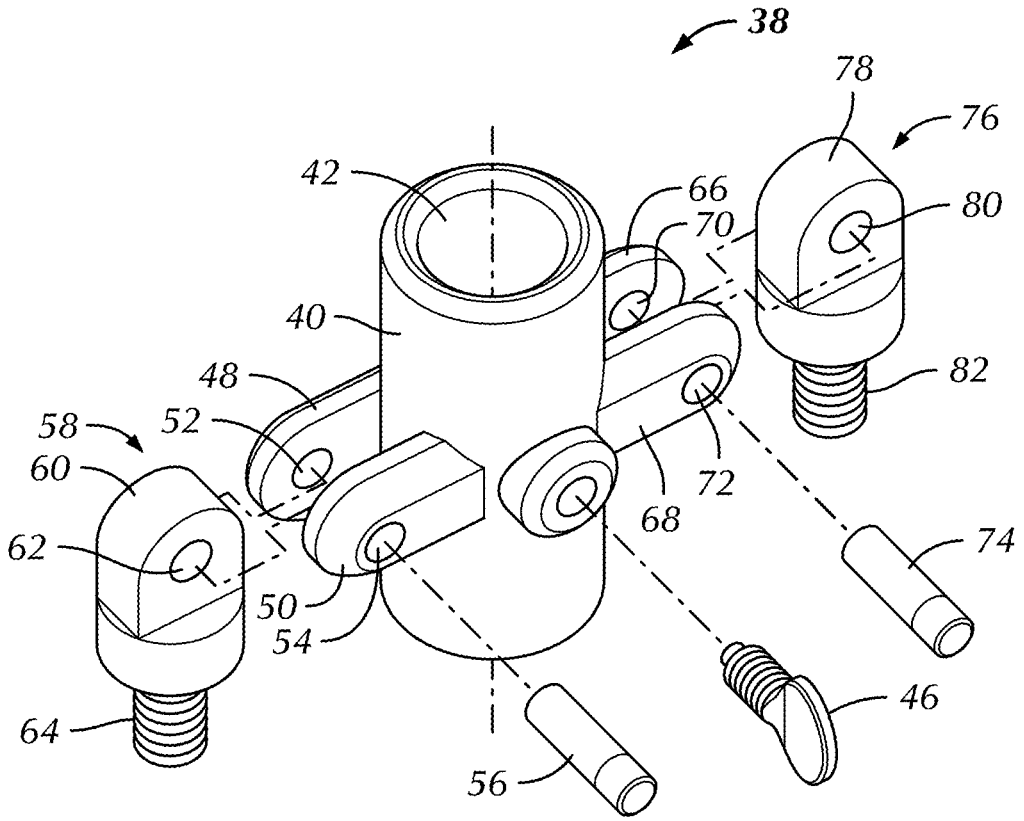
FIG. 10 is an exploded view of the hinge support member shown in FIGS. 8 and 9.

In a specific embodiment, the sink apparatus 10 may include a hinge support member 38. With reference to FIGS. 8-10, in a specific embodiment, the hinge support member 38 may include a central hinge body member 40. In a specific embodiment, the central hinge body member 40 may be in the general shape of a cylindrical sleeve, and may include an internal bore 42 extending therethrough. The internal bore 42 is adapted to receive the elongated body member 22 of the central support member 16, as shown for example in FIG. 3. This allows the hinge support member 38 to be disposed for slidable movement up and down the central support member 16, as discussed further below. Referring again to FIGS. 8-10, the central hinge body member 40 may include a transverse bore 44 in a side wall of the central hinge body member 40. The transverse bore 44 may be threaded and adapted for threadable engagement with a thumb screw 46. A central axis of the transverse bore 44 may be generally perpendicular to a central axis of the central hinge body member 40. The thumb screw 46 has a distal end adapted for engagement with the elongated body member 22 of the central support member 16 to secure the hinge support member 38 and lock it in place so as to prevent it from slidable movement relative to the elongated body member 22 when in the locked position.

Still referring to FIGS. 8-10, the hinge support member 38 may include a left rear hinge arm 48 and a left forward hinge arm 50, each of which extends outwardly from a left side of the central hinge body member 40. The left rear hinge arm 48 includes a left rear transverse bore 52, and the left forward hinge arm 50 includes a left forward transverse bore 54. The left rear transverse bore 52 and the left forward transverse bore 54 are aligned so as to receive a left hinge pin 56. A left hinge pivot member 58 may include a head 60 having a transverse bore 62 therethrough. The head 60 is positioned between the left rear hinge arm 48 and the left forward hinge arm 50 with the transverse bore 62 on the head 60 in coaxial alignment with the left rear transverse bore 52 and the left forward transverse bore 54. The left hinge pin 56 extends through all three transverse bores 52/62/54 to pivotably attach the left hinge pivot member 58 between the left rear hinge arm 48 and the left forward hinge arm 50. The left hinge pivot member 58 also includes a left threaded rod 64, the purpose of which will be explained below.

Still referring to FIGS. 8-10, the hinge support member 38 may include a right rear hinge arm 66 and a right forward hinge arm 68, each of which extends outwardly from a right side of the central hinge body member 40. In a specific embodiment, the right rear and forward hinge arms 66 and 68 may be directly opposite the left rear and forward hinge arms 48 and 50. The right rear hinge arm 66 includes a right rear transverse bore 70, and the right forward hinge arm 68 includes a right forward transverse bore 72. The right rear transverse bore 70 and the right forward transverse bore 72 are aligned so as to receive a right hinge pin 74. A right hinge pivot member 76 may include a head 78 having a transverse bore 80 therethrough. The head 78 is positioned between the right rear hinge arm 66 and the right forward hinge arm 68 with the transverse bore 80 on the head 78 in coaxial alignment with the right rear transverse bore 70 and the right forward transverse bore 72. The right hinge pin 74 extends through all three transverse bores 70/80/72 to pivotably attach the right hinge pivot member 76 between the right rear hinge arm 66 and the right forward hinge arm 68. The right hinge pivot member 76 also includes a right threaded rod 82, the purpose of which will be explained below.

Referring back to FIGS. 1-3, the rear support member 18 may include a rear elongated body member 84 having an internal threaded bore 86 extending therethrough. The rear support member 18 may include a rear threaded rod 88 that is threadably engaged with the internal threaded bore 86 at a left end of the rear elongated support member 84. In a specific embodiment, the rear threaded rod 88 may include a rear handle 90 that may be formed as part of the rear threaded rod 88. In a specific embodiment, the rear handle 90 may be in the shape of a wing nut. In a specific embodiment, the rear threaded rod 88 may be connected to a rear engagement member 92. In a specific embodiment, the rear engagement member 92 may be connected to the rear handle 90. In a specific embodiment, the rear engagement member 92 may be formed from a rubber material. In a specific embodiment, the rear engagement member 92 may have a trapezoidal cross-section, and may have the shorter side of the trapezoidal member positioned away from the rear handle 90 (i.e., at a distal end relative to the rear threaded rod 88). In a specific embodiment, in comparison to the upper and lower engagement members 32 and 36 associated with the central support member 16, the rear engagement member 90 may be a wider and/or have a smaller thickness.

A right end of the rear support member 18 may be connected to the central support member 16. In a specific embodiment, as shown for example in FIGS. 6 and 7, which illustrate the hinge support member 38 shown in FIGS. 8-10 slidably mounted to the elongated body member 22 of the central support member 16, the left threaded rod 64 on the left hinge pivot member 58 (see FIGS. 8-10) may be threadably engaged with the internal threaded bore 86 of the rear elongated support member 84 on the rear support member 18. In another specific embodiment, as shown in FIGS. 1-3, a modified hinge support member 38' may be provided in which the right side of the hinge support member 38' has a right hinge pivot member 76 as shown in FIGS. 8-10, but instead of a left hinge pivot member 58 and corresponding hinge arms 48 and 50 as shown in FIGS. 8-10, the left side of the hinge support member 38' instead includes a fixed left threaded rod 64' that may be threadably engaged with the internal threaded bore 86 of the rear elongated support member 84 on the rear support member 18.

Referring again to FIGS. 1-3, the forward support member 20 may include a forward elongated body member 94 having an internal threaded bore 96 extending therethrough. The forward support member 20 may include a forward threaded rod 98 that is threadably engaged with the internal threaded bore 96 at a right end of the forward elongated support member 94. In a specific embodiment, the forward threaded rod 98 may include a forward handle 100 that may be formed as part of the forward threaded rod 98. In a specific embodiment, the forward handle 100 may be in the shape of a wing nut. In a specific embodiment, the forward threaded rod 98 may be connected to a forward engagement member 102. In a specific embodiment, the forward engagement member 102 may be connected to the forward handle 100. In a specific embodiment, the forward engagement member 102 may be formed from a rubber material. In a specific embodiment, the forward engagement member 102 may have a trapezoidal cross-section, and may have the shorter side of the trapezoidal member positioned away from the forward handle 100 (i.e., at a distal end relative to the forward threaded rod 98).

A left end of the forward support member 20 may be connected to the central support member 16. In a specific embodiment, as shown for example in FIGS. 1-3, 6 and 7, which illustrate the hinge support member 38 shown in FIGS. 8-10 slidably mounted to the elongated body member 22 of the central support member 16, the right threaded rod 82 on the right hinge pivot member 76 (see FIGS. 8-10) may be threadably engaged with the internal threaded bore 96 of the forward elongated support member 94 on the forward support member 20.

Figure 4:
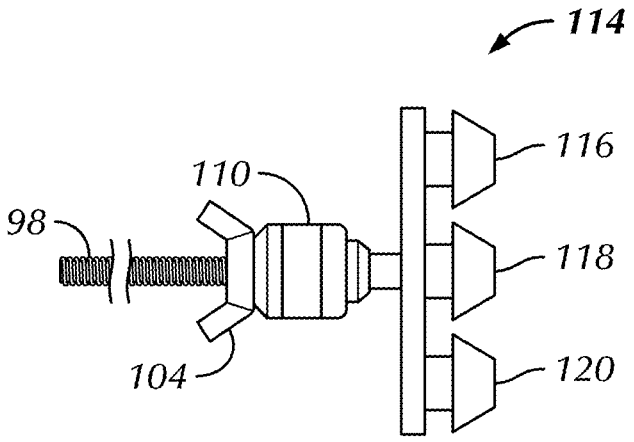
FIG. 4 is a side view showing a specific embodiment of an alternative design for a stopper that may be used as part of a sink apparatus constructed in accordance with one aspect of the present inventions.
Figure 5:
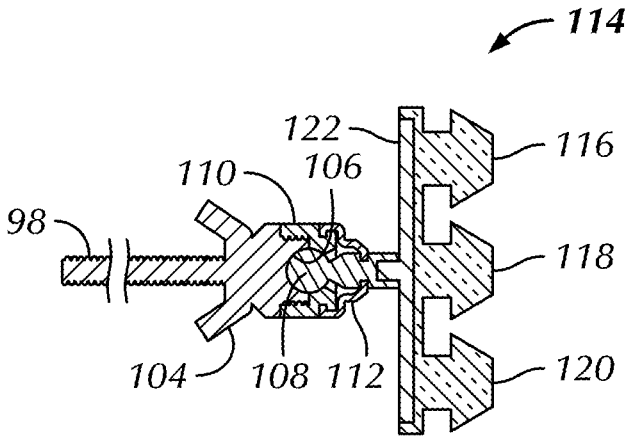
FIG. 5 is a side view similar to FIG. 4 but showing the portion of the apparatus in cross-section.
Figure 6:
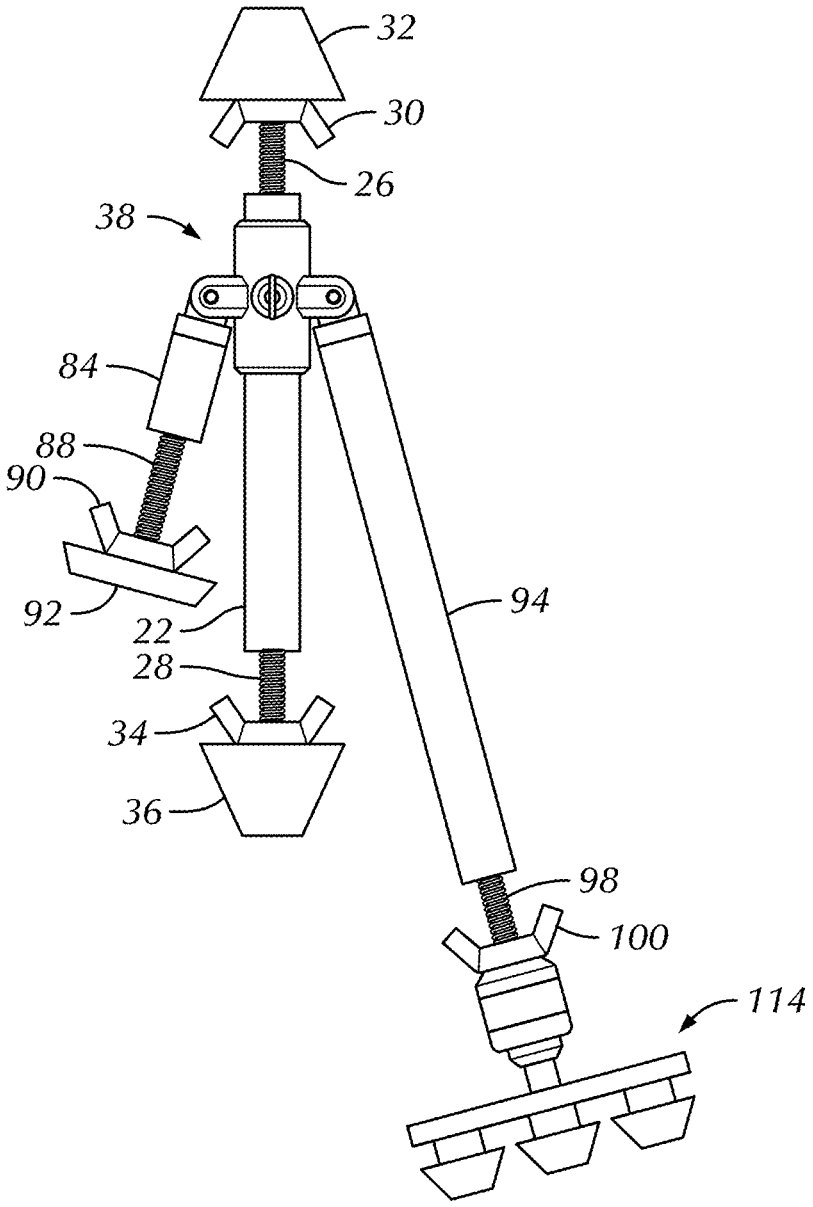
FIG. 6 is a perspective view a specific embodiment of a sink apparatus constructed in accordance with one aspect of the present inventions, and is shown in a non-deployed or relaxed state.
Figure 7:
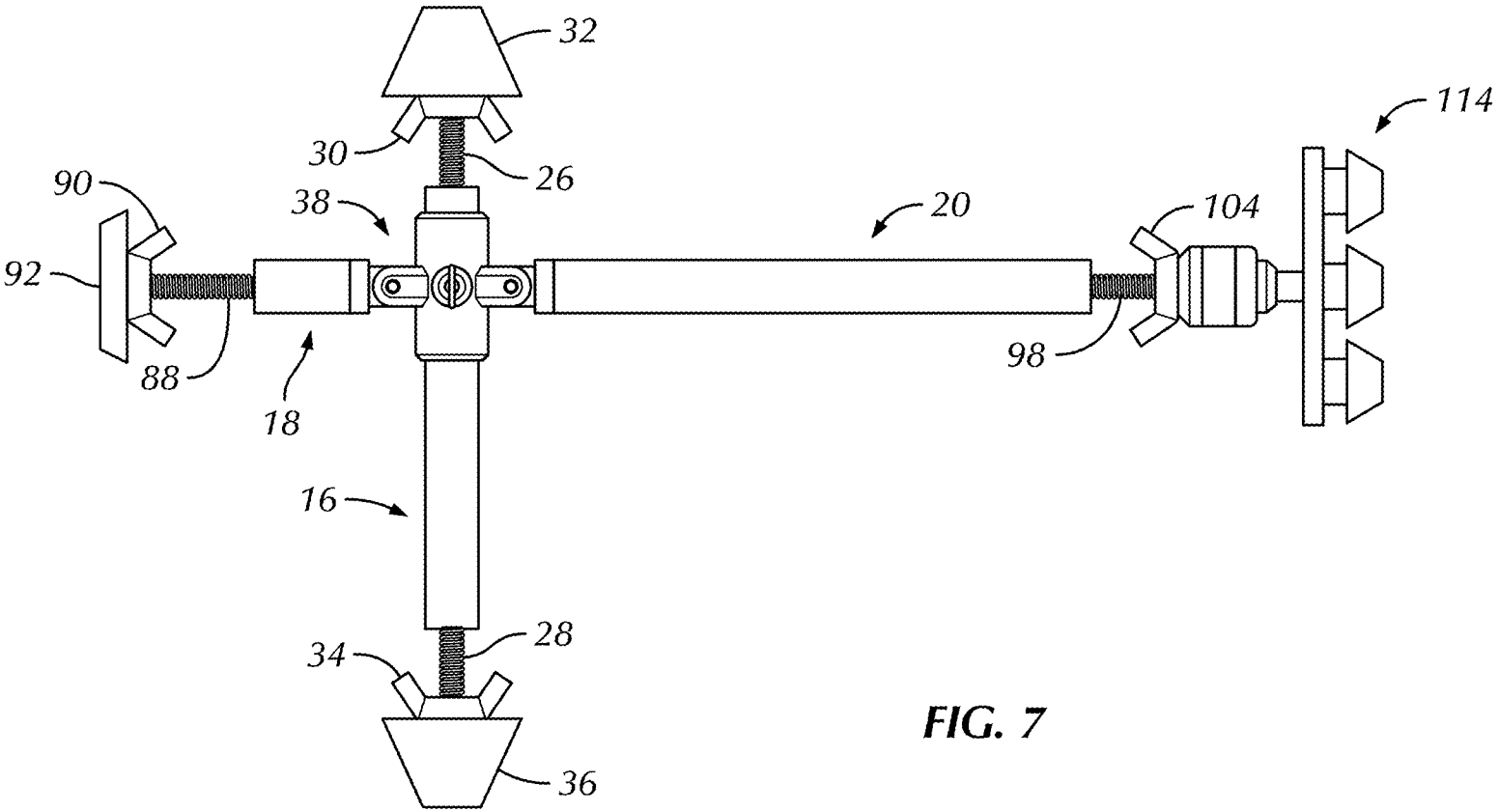
FIG. 7 is a perspective view similar to FIG. 6 but showing the sink apparatus in a simulated deployed position.

In another specific embodiment, instead of the forward engagement member 102 shown in FIGS. 1-3 that is attached to the forward threaded rod 98 that is part of the forward support member 20, an alternative configuration may be provided. In a specific embodiment, as shown in FIGS. 4-6, a handle 104 may be connected to or formed as part of the forward threaded rod 98. The handle 104 may be partially in the form of a wing nut. The handle 104 may include a socket 106 that is adapted for pivotal engagement with a ball 108 to form a ball-and-socket joint. An internally-threaded cap 110 may be threadably engaged with male threads on the handle 104 to hold the ball 108 in engagement with the socket 106. A cover 112, such as made from silicone, may be positioned at the end of the cap 110 to keep water and debris out of the ball-and-socket joint. The ball 108 may be connected to a modified forward engagement member 114. In a specific embodiment, the modified forward engagement member 114 may include a plurality of plugs 116, 118 and 120, the purpose of which will be explained below. The modified forward engagement member 114 may be mounted to a plate 122 that may be connected to the ball 108. The ball 108 may include a body member having an internal bore adapted for engagement with a peg extending from the plate 122.

The manner of operation and use of the present inventions will now be explained. Referring initially to FIG. 1, the sink apparatus 10 is positioned in the sink 12. In a specific embodiment, the central support member 16 may initially be positioned between the sink faucet 14 and a primary sink drain 124. The upper engagement member 32 attached to the central support member 16 may be positioned in contact with a water spout on the faucet 14, and the lower engagement member 36 attached to the central support member 20 may be positioned in contact with the primary sink drain 124. Depending on the size of the sink and distance between the water spout and the primary sink drain 124, it may be necessary to screw the upper threaded rod 26 and the lower threaded rod 28 inwardly or outwardly to shorten or lengthen the length of the central support member 20 by moving the upper engagement member 32 and the lower engagement member 36 towards or away from each other. Once there is sufficient clearance and proximity to place the lower engagement member 36 in contact with the sink drain 124 and then position the upper engagement member 32 beneath the water spout, the upper handle 30 connected to the upper engagement member 32 can then be rotated to move the upper engagement member 32 upwardly into secure engagement with the water spout. Note that the lower engagement member 36 should be sufficiently engaged with the sink drain 124 so as to cover it and prevent outflow of any debris when compressed air is applied to an AC drain line that is in fluid communication with the sink drain 124. Alternatively, if the sink drain 124 already has a stopper that is in sealing relationship with the sink drain 124, then the lower engagement member 36 can be placed on top of the stopper to hold it down and prevent it from being dislodged with compressed air is applied to the AC drain line.

Next, the forward support member 20 can be engaged with an overflow drain 126 at the front of the sink 12. The forward engagement member 102 on the forward support member 20 should be placed into sealing engagement with the overflow drain 126 so as to prevent outflow of debris when compressed air is supplied to an AC drain line that is in fluid communication with the overflow drain. Depending on the size and shape of the overflow drain 126, it may be necessary or preferable to use a modified forward engagement member 114, such as shown in FIGS. 4-6 to fully cover and seal the overflow drain 126.

Last, in a specific embodiment, the rear support member 18 may be engaged with a back wall of the sink 12, if the additional support is deemed necessary. It is noted that the rear engagement member 92 may include a scratchproof material to avoid scratching the back of the sink 12. The rear support member 18 may be used to provide additional stability and strength to keep the central support member 16 and the forward support member 20 in fixed positions when compressed air pressure is applied to the AC drain line.

Figure 11:
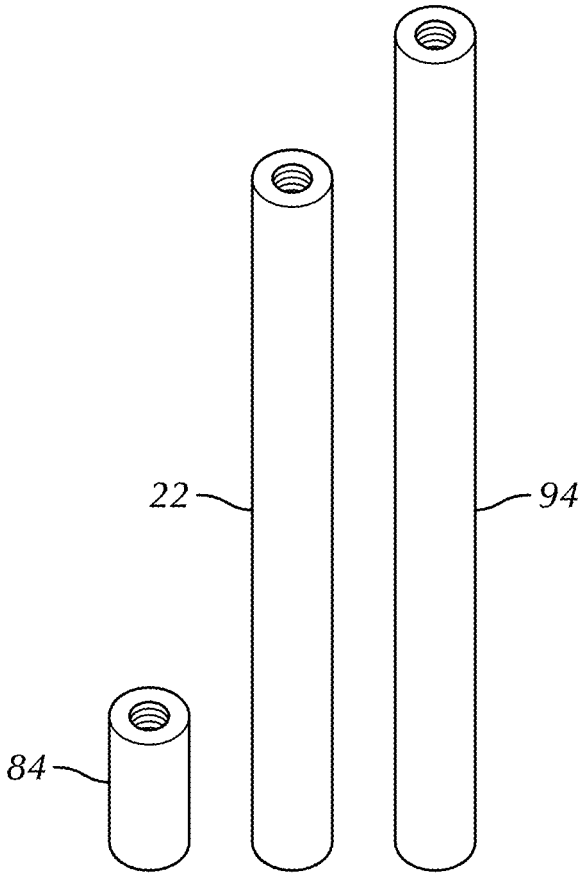
FIG. 11 shows perspective views of various lengths of specific embodiments of standoff members that may form part of a sink apparatus constructed in accordance with one aspect of the present inventions.

It can now be seen that use of the present inventions can be used to seal all open drainage holes of the sink from the room it is in. As shown in FIG. 11, support rods of various lengths can be provided for different applications such as a deeper sink, taller faucet, or some commercial applications.

This tool is used in the HVAC industry and plumbing industry for drains that terminate to a bathroom sink. This allows for pressure to be applied at the rate needed from the attic to push the clog or stoppage from the central air conditioning primary drain line, and not spray the clog or stoppage out of the sink drainage holes and all over the bathroom. This allows proper maintenance and service reducing the need to apply a towel or other means to the sink drainage holes for protection against clogs and stoppage of overspray from the drain plumbing into the bathroom space.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. It should also be understood that various features and aspects of the various embodiments discussed above and illustrated in the Figures may be selectively incorporated with and/or removed from a specific embodiment to arrive at another specific embodiment. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A sink apparatus for containing debris when compressed air is applied to a drain line that is connected to a sink drain, the sink apparatus comprising:

a central support member having an elongated body member, an upper engagement member and a lower engagement member, the upper engagement member being moveable relative to an upper end of the elongated body member of the central support member, and the lower engagement member being movable relative to a lower end of the elongated body member of the central support member; and a forward support member having an elongated body member and a forward engagement member, a rear end of the elongated body member of the forward support member being connected to the central support member, the forward engagement member being moveable relative to a forward end of the elongated body member of the forward support member.

2. The sink apparatus of claim 1, further including a rear support member having an elongated body member and a rear engagement member, a forward end of the elongated body member of the rear support member being connected to the central support member, the rear engagement member being moveable related to a rear end of the elongated body member of the rear support member.

3. The sink apparatus of claim 1, wherein the forward support member is hingedly connected to the central support member.

4. The sink apparatus of claim 2, wherein the rear support member is hingedly connected to the central support member.

5. The sink apparatus of claim 1, wherein the elongated body member of the central support member includes an internal threaded bore extending therethrough, and the sink apparatus further includes an upper threaded rod threadably engaged with the internal treaded bore of the elongated body member of the central support member, and a lower threaded rod threadably engaged with the internal threaded bore of the elongated body member of the central support member.

6. The sink apparatus of claim 5, wherein the upper threaded rod is connected to the upper engagement member, and the lower threaded rod is connected to the lower engagement member.

7. The sink apparatus of claim 1, wherein the elongated body member of the forward support member includes an internal threaded bore extending therethrough, and the sink apparatus further includes a forward threaded rod threadably engaged with the internal treaded bore of the elongated body member of the forward support member, and the forward threaded rod is connected to the forward engagement member.

8. The sink apparatus of claim 1, further including a hinge support member slidably and releasably engaged with the central support member, and including a right hinge pivot member having a right threaded rod, the right threaded rod being threadably engaged with an internal threaded bore of the elongated body member of the forward support member.

9. The sink apparatus of claim 1, wherein the forward engagement member includes a plurality of plug members.

10. A sink apparatus for containing debris when compressed air is applied to a drain line that is connected to a sink drain, the sink apparatus comprising:

a central support member having an elongated body member, an upper engagement member and a lower engagement member, the upper engagement member being moveable relative to an upper end of the elongated body member of the central support member, and the lower engagement member being movable relative to a lower end of the elongated body member of the central support member;

a forward support member having an elongated body member and a forward engagement member, a rear end of the elongated body member of the forward support member being connected to the central support member, the forward engagement member being moveable relative to a forward end of the elongated body member of the forward support member; and a rear support member having an elongated body member and a rear engagement member, a forward end of the elongated body member of the rear support member being connected to the central support member, the rear engagement member being moveable related to a rear end of the elongated body member of the rear support member.

11. The sink apparatus of claim 10, wherein each of the forward support member and the rear support member is hingedly connected to the central support member.

12. The sink apparatus of claim 10, wherein the elongated body member of the central support member includes an internal threaded bore extending therethrough, and the sink apparatus further includes an upper threaded rod threadably engaged with the internal treaded bore of the elongated body member of the central support member, and a lower threaded rod threadably engaged with the internal threaded bore of the elongated body member of the central support member.

13. The sink apparatus of claim 12, wherein the upper threaded rod is connected to the upper engagement member and includes an upper handle, and the lower threaded rod is connected to the lower engagement member and includes a lower handle.

14. The sink apparatus of claim 13, wherein each of the upper handle and the lower handle is in the shape of a wing nut.

15. The sink apparatus of claim 10, wherein the elongated body member of the forward support member includes an internal threaded bore extending therethrough, and the sink apparatus further includes a forward threaded rod threadably engaged with the internal treaded bore of the elongated body member of the forward support member, and the forward threaded rod is connected to the forward engagement member.

16. The sink apparatus of claim 10, further including a hinge support member slidably and releasably engaged with the central support member, and including a right hinge pivot member having a right threaded rod, the right threaded rod being threadably engaged with an internal threaded bore of the elongated body member of the forward support member.

17. The sink apparatus of claim 10, wherein the forward engagement member includes a plurality of plug members.

18. A method for containing debris when compressed air is applied to an air conditioner drain line that is connected to a sink drain, the method comprising:

providing a sink apparatus having a central support member and a forward support member, the central support member having an upper engagement member and a lower engagement member, and the forward support member having a forward engagement member;

engaging the upper engagement member of the central support member with a faucet attached to a sink;

engaging the lower engagement member of the central support member with a sink drain of the sink that is in fluid communication with the air conditioner drain line; and engaging the forward engagement member of the forward support member with an overflow drain of the sink that is in fluid communication with the air conditioner drain line.

19. The method of claim 18, further including:

engaging a rear engagement member of a rear support member that is attached to central support member with a wall of the sink.

20. The method of claim 18, further including:

rotating an upper threaded rod that is threadably engaged with an internal bore of the central support member and is connected to the upper engagement member;

rotating a lower threaded rod that is threadably engaged with the internal bore of the central support member; and rotating a forward threaded rod that is threadably engaged with an internal bore of the forward support member.

* * * * *